United States Patent [19]

Stanley

[11] 4,134,578

[45] Jan. 16, 1979

[54] CLAMP

[76] Inventor: James R. Stanley, U.S. Federal Prison, PMB 39871-133, Atlanta, Ga. 30315

[21] Appl. No.: 721,126

[22] Filed: Sep. 20, 1976

[51] Int. Cl.[2] ..... B25B 1/10

[52] U.S. Cl. ..... 269/249; 269/258

[58] Field of Search ..... 269/258, 249, 279; 81/418, 420, 421, 422, 423, 424, 425 R, 425 A

[56] References Cited

U.S. PATENT DOCUMENTS

| | | | |
|---|---|---|---|
| 1,063,332 | 6/1913 | Diehl | 269/249 |
| 1,405,325 | 1/1922 | Posch | 269/258 |
| 2,399,714 | 5/1946 | Waśilewski | 269/249 |
| 2,610,661 | 9/1952 | Romine | 269/249 |
| 2,882,656 | 4/1951 | Novkov | 269/258 |
| 3,383,963 | 5/1968 | Vondrachek | 81/423 |

*Primary Examiner*—Robert C. Watson
*Attorney, Agent, or Firm*—Robert B. Kennedy

[57] ABSTRACT

A clamp is disclosed comprising a frame having two rigid supports spaced mutually apart along an axis and a screw threadedly mounted to one of the supports for axial movement along the axis. A first pressure contact member is pivotably mounted to an end of the screw between the two frame supports. A yoke is pivotably mounted to the other of the two supports for rotary movement about the axis with two yoke arms straddling the axis. A second pressure contact member is mounted to each of the two yoke arms for rotary movement between the two frame supports aside the frame axis.

5 Claims, 9 Drawing Figures

CLAMP

BACKGROUND OF THE INVENTION

This invention relates generally to clamps, and particularly to clamps of the type having general utility.

Heretofore, C-shaped yolk clamps have been devised, usually made of cast steel or drop forged, which are provided with a pressure screw upon which a ball or a ball swivel pad is attached. This ball or pad is brought to bear pressure upon material which rests against an anvil or rigid end of the C clamp, which also may or may not have a ball mounted swivel pad attached.

The just described prior art clamps have had numerous problems associated with their usage. For example, they have experienced slippage when adequate pressure to hold work is applied. They have marked or marred materials being so held. They have had very limited application and have been virtually impossible to use on materials of a shape other than flat.

Accordingly, it is an object of the present invention to provide a clamp which may securely hold any type material to which the prior art C-shaped clamps are applicable, with optimal pressure and with no scarring or marring.

Another object of the invention is to provide a clamp which can incorporate a wide range of materials for use as pressure surfaces while leaving no area of solid material fabrication outside its domain.

Another object of the invention is to provide a clamp which may hold metal, wood, plastic, rubber, and glass without damage or scarring.

Yet another object of the invention is to provide a clamp capable of securely holding irregularly shaped surfaces during their fabrication such as by welding, gluing and riveting.

SUMMARY OF THE INVENTION

In a preferred form of the invention a clamp is provided comprising a frame having two rigid supports spaced mutually apart along an axis, and a screw threadedly mounted to one of the supports for axial movement along the axis. A first pressure contact member is pivotably mounted to an end of the screw between the two frame supports. A yoke is pivotably mounted to the other of the supports for rotary movement about the axis with two yoke arms straddling the axis. A second pressure contact member is mounted to each of the two yoke arms for rotary movement between the two frame supports aside the frame axis.

BRIEF DESCRIPTION OF THE DRAWING

FIG. 4A is a plan view of a modified form of a portion of the clamp while

FIG. 5A is a plan view of another modified form of the clamp while

FIG. 6A is a plan view of the clamp in yet another modified form shown holding a work piece while

DESCRIPTION OF THE PREFERRED EMBODIMENTS

Figure 1:
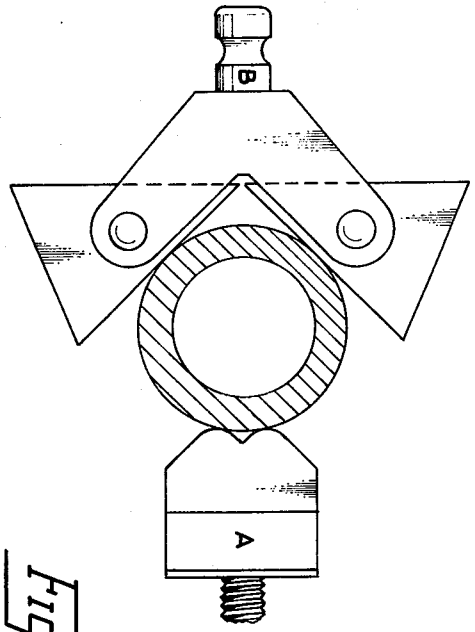
FIGS. 1 – 3 are three plan views of the clamp of the present invention, with a portion shown broken away for clarity, shown in gripping engagement with three work pieces of mutually different shapes.
Figure 2:
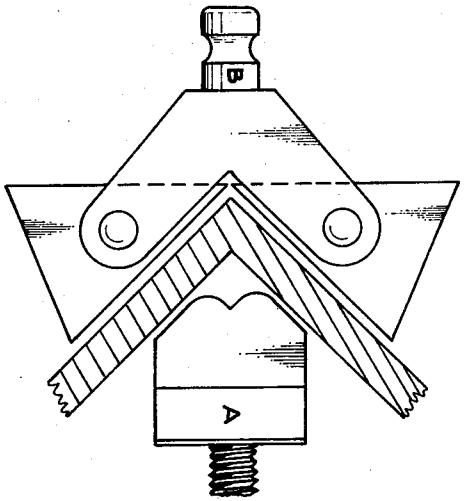
Figure 3:
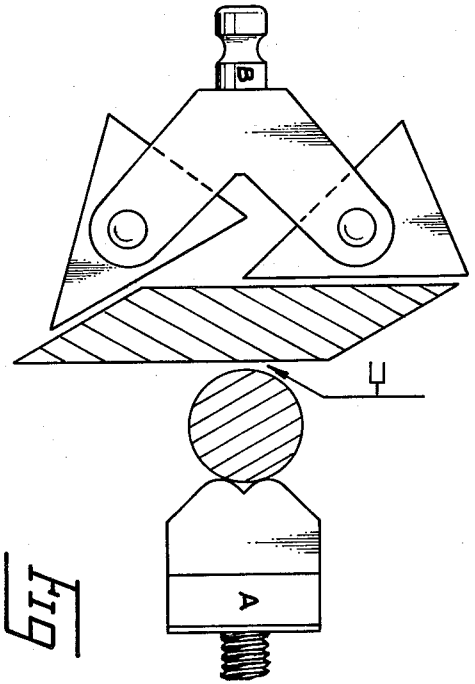
Figure 4A:
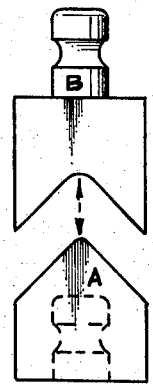
Figure 4B:
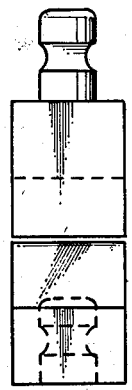
FIG. 4B is a side elevational view thereof.
Figure 5A:
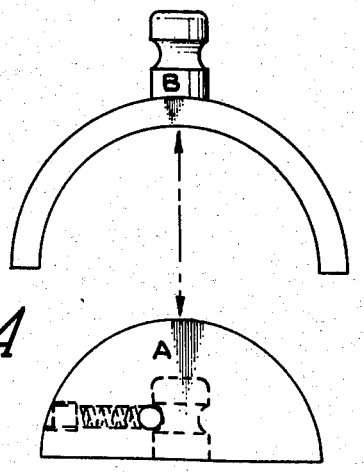
Figure 5B:
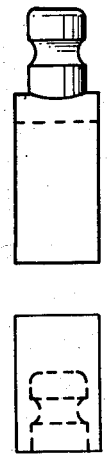
FIG. 5B is a side elevational view thereof.
Figure 6A:
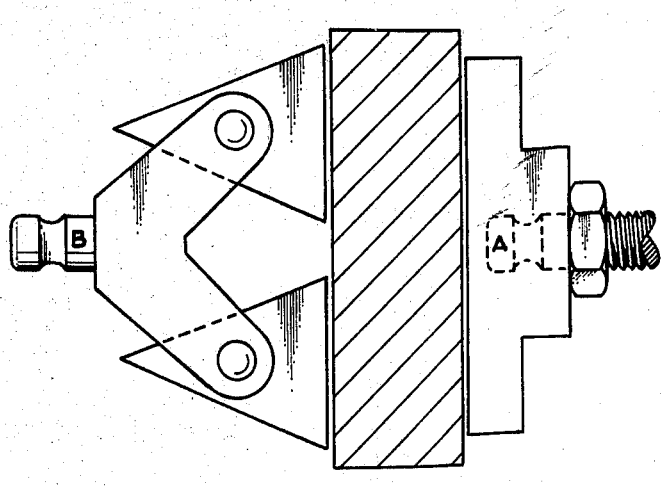
Figure 6B:
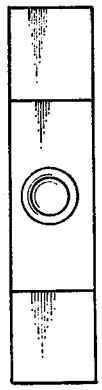
FIG. 6B is a side elevational view thereof.

With reference now to the drawing, there is shown a clamp emboding the present invention which comprises an upper part or pressure contact member A mounted to a pressure screw by means of a spring loaded snap ball retainer which member is free to turn 360° laterally to the pressure screw. Its shape is similar to a pentagon with its point partially removed a notched. Each angle here is 44° from center line or direction of pressure, and 88° overally. This allows full purchase within a 90° angle.

The lower support bridge of the clamp is provided with a laterally grooved stud which is retained in the end B of the clamp by means of a spring loaded snap ball. It too is free to turn 360° laterally to center line of pressure screw. The part B-1 forms a 90° V with two arms extended to provide the clevis which supports part B-2 at the other end. Two triangular shaped contact surfaces, each mounted with a clevis pin retainer by spring steel E-ring, located 180° from each other to the end of the 90° supporting bridge B-1. These isosceles triangles are free to turn 320° radially to center line of pressure and are stopped when one longer lower surface comes into contact with the upper inner center of the supporting bridge B-1. When both triangles are thus stopped, the angle formed between the longer upper surface is 90°. In this position part A can fully penetrate the angle to hold very small objects.

The contact surfaces here can be made of covered or impregnated with steel, plastic, rubber or wood. The contact surface shape can be altered to accomodate any special application and still make the flexibility of the clamp.

It should be understood that the just described embodiments merely illustrate principles of the invention in selected preferred forms. Many modifications, additions, and deletions, may, of course, be made thereto without departure from the spirit and scope of the invention as set forth in the following claims.

I claim:

1. A clamp comprising a frame having two rigid supports spaced mutually apart along an axis; a screw threadly mounted to one of said supports for axial movement along said axis; a first pressure contact member pivotably mounted to an end of said screw between said two frame supports; a yoke pivotably mounted to the other of said supports for rotary movement about said axis with two yoke arms straddling said axis; and a second pressure contact member mounted to each of said two yoke arms for rotary movement between said two frame supports about mutually parallel axes aside said frame axis.

2. A clamp in accordance with claim 1 wherein said frame is C-shaped.

3. A clamp comprising a frame having two rigid supports spaced mutually apart along an axis; a screw threadly mounted to one of said supports for axial movement along said axis; a first wedge shaped pressure contact member pivotably mounted to an end of said screw between said two frame supports; a yoke pivotably mounted to the other of said supports for rotary movement about said axis with two yoke arms straddling said axis; and a second pressure contact member mounted to each of said two yoke arms for rotary movement between said two frame supports aside said axis.

4. A clamp comprising a frame having two rigid supports spaced mutually apart along an axis; a screw threadly mounted to one of said supports for axial movement along said axis; a first pressure contact member pivotably mounted to an end of said screw between between said two frame supports; a yoke pivotably mounted to the other of said supports for rotary movement about said axis with two yoke arms straddling said axis; and a triangular shaped second pressure contact member mounted to each of said two yoke arms for rotary movement between said two frame supports aside said axis.

5. A clamp in accordance with claim 4 wherein said first pressure contact member is wedge shaped.

* * * * *